US005535822A

United States Patent [19]

Schock et al.

[11] Patent Number: 5,535,822

[45] Date of Patent: Jul. 16, 1996

[54] APPARATUS FOR RETRIEVING WHIPSTOCK

[75] Inventors: William H. Schock; Shannon P. Rogers, both of Lafayette, La.

[73] Assignee: Enterra Corporation, Lafayette, La.

[21] Appl. No.: 303,312

[22] Filed: Sep. 8, 1994

[51] Int. Cl.[6] ..... E03B 3/11

[52] U.S. Cl. ..... 166/50; 166/117.6; 175/80; 175/82

[58] Field of Search ..... 166/117.5, 117.6, 166/50, 384; 175/80–82

[56] References Cited

U.S. PATENT DOCUMENTS

| | | | |
|---|---|---|---|
| Re. 20,398 | 6/1937 | Keever | 175/83 |
| 1,502,428 | 7/1924 | Getty | 166/217 |
| 1,634,582 | 7/1927 | Kinzbach | 166/217 |
| 1,804,819 | 5/1931 | Spencer, Jr. et al. | 175/81 |
| 1,806,509 | 5/1931 | Straatman | 175/79 |
| 1,970,761 | 8/1934 | McVicar | 175/82 |
| 2,065,896 | 12/1936 | Keever | 175/83 |
| 2,102,055 | 12/1937 | Brauer | 166/217 |
| 2,105,721 | 1/1938 | Cutrer et al. | 175/83 |
| 2,105,722 | 1/1938 | Barrett et al. | 175/82 |
| 2,107,420 | 2/1938 | Kothny | 175/82 |
| 2,119,746 | 6/1938 | Lane | 166/217 |
| 2,132,061 | 10/1938 | Walker | 166/117.6 |
| 2,147,585 | 2/1939 | Trotter | 175/83 |
| 2,170,284 | 8/1939 | Eastman | 175/82 |
| 2,171,020 | 8/1939 | Ackley | 166/117.6 |
| 2,196,517 | 4/1940 | Bolton | 175/82 |
| 2,196,528 | 4/1940 | Hughes | 175/81 |
| 2,196,944 | 4/1940 | Sharp | 175/82 |
| 2,207,920 | 7/1940 | Hughes | 175/81 |
| 2,216,963 | 10/1940 | Sinclair | 175/82 |
| 2,252,620 | 8/1941 | DeLong . | |
| 2,258,001 | 10/1941 | Chamberlain | 175/79 |
| 2,285,024 | 6/1942 | Ferguson | 175/79 |
| 2,296,161 | 9/1942 | Hall, Jr. . | |
| 2,312,805 | 3/1943 | Douglas | 175/79 |
| 2,331,293 | 10/1943 | Ballard | 175/82 |
| 2,334,746 | 11/1943 | Brantly | 175/82 |
| 2,357,330 | 9/1944 | Hyer | 175/82 |
| 2,362,529 | 11/1944 | Barrett et al. | 166/117.6 |
| 2,368,413 | 1/1945 | Creighton | 175/82 |
| 2,401,893 | 6/1946 | Williams, Jr. | 166/117.6 |
| 2,438,293 | 3/1948 | Livingston | 175/82 |

(List continued on next page.)

OTHER PUBLICATIONS

P. 17 of Triumph–LOR brochure re: Whipstock.
P. 16 of Triumph–LOR brochure re: Milling Tools.
Homco A–1 Bit & Tool brochure pp. 9–11, 25–26.
Lindsey Completion Systems, Inc. General Catalog 1992–1993 (cover page, pp. 8, 9, 27).
A–Z Grant International General Catalog 1992–1993 (cover page, p. 15).
Pp. 55 and 59 of Eastman Christensen brochure re: Special Products & Services.
A–Z Grant International brochure (pp. 8, 9, 27).
Eastman Christensen General Catalog 1992–1993 (cover page, pp. 55, 56, 59, listing of locations).
Frank's 1992–1993 General Catalog (cover page, p. 14, listing of locations).
McMaster–Carr brochure (no page No., 1st item in 1st column entitled "Grab–It Grips".
McMaster–Carr brochure (p. 623).

*Primary Examiner*—Roger J. Schoeppel
*Attorney, Agent, or Firm*—Pravel, Hewitt, Kimball & Krieger

[57] ABSTRACT

The retrieving tool includes a first mandrel having an upper end adapted for attachment to a running string, and a lower end. A second mandrel is positioned below the lower end of the first mandrel. The second mandrel and first mandrel are interconnected by a cam/grip link mechanism. An external actuator cylinder extends over the upper mandrel into attachment to the lower mandrel such that the cam grip mechanism is moved into engagement with the upper end of a whipstock by movement of the upper mandrel away from the lower mandrel and the cam grip mechanism is released by movement of the lower mandrel through its connection to the external actuator toward the upper mandrel.

8 Claims, 3 Drawing Sheets

U.S. PATENT DOCUMENTS

| | | | |
|---|---|---|---|
| 2,445,100 | 7/1948 | Wright | 166/117.6 |
| 2,495,439 | 1/1950 | Brimble | 166/117.6 |
| 2,498,159 | 2/1950 | Gammill | 175/82 |
| 2,498,192 | 2/1950 | Wright | 175/82 |
| 2,506,799 | 5/1950 | Livingston | 166/117.6 |
| 2,544,982 | 3/1951 | Buttolph | 175/82 |
| 2,553,874 | 5/1951 | Spaulding et al. | 175/82 |
| 2,586,662 | 2/1952 | Jackson | 175/82 |
| 2,586,878 | 2/1952 | Staton | 175/83 |
| 2,632,630 | 3/1953 | Storm | 175/82 |
| 2,634,097 | 4/1953 | Zublin | 175/82 |
| 2,642,267 | 6/1953 | Zublin . | |
| 2,667,332 | 1/1954 | McCune et al. | 175/83 |
| 2,669,428 | 2/1954 | Zublin | 175/82 |
| 2,669,429 | 2/1954 | Zublin | 175/82 |
| 2,669,430 | 2/1954 | Zublin | 175/82 |
| 2,691,507 | 10/1954 | Brown | 175/82 |
| 2,694,549 | 11/1954 | James | 175/82 |
| 2,699,920 | 1/1955 | Zublin | 166/117.6 |
| 2,709,070 | 5/1955 | Bielsten | 175/79 |
| 2,712,436 | 7/1955 | McCune et al. | 175/82 |
| 2,716,539 | 8/1955 | Pickard | 175/79 |
| 2,716,540 | 8/1955 | McCune et al. | 166/117.6 |
| 2,716,542 | 8/1955 | Goble | 175/82 |
| 2,726,847 | 12/1955 | McCune et al. | 175/79 |
| 2,766,010 | 10/1956 | Hester | 166/217 |
| 2,770,444 | 11/1956 | Neal | 166/117.5 |
| 2,778,603 | 1/1957 | McCune et al. | 175/79 |
| 2,779,570 | 1/1957 | Roper | 175/79 |
| 2,797,893 | 7/1957 | McCune et al. | 175/79 |
| 2,797,894 | 7/1957 | Meyer | 166/117.5 |
| 2,821,362 | 1/1958 | Hatcher | 175/82 |
| 2,823,012 | 2/1958 | Hanna | 166/117.5 |
| 2,839,270 | 6/1958 | McCune et al. | 166/117.6 |
| 2,858,107 | 10/1958 | Colmerauer | 166/117.6 |
| 2,906,499 | 9/1959 | Travis | 175/82 |
| 2,921,630 | 1/1960 | Le Bus, Sr. | 175/80 |
| 2,965,182 | 12/1960 | Galeener | 175/82 |
| 3,011,568 | 12/1961 | Grimm | 166/117.6 |
| 3,029,874 | 4/1962 | Turman | 166/117.6 |
| 3,075,583 | 1/1963 | Nielsen et al. | 166/117.5 |
| 3,116,799 | 1/1964 | Lemons | 175/80 |
| 3,194,327 | 7/1965 | Smithson | 175/61 |
| 3,215,204 | 11/1965 | Sims | 166/117.5 |
| 3,330,349 | 7/1967 | Owsley et al. | 166/117.5 |
| 3,353,607 | 11/1967 | Kinley | 166/117.5 |
| 3,477,524 | 11/1969 | Marks, Jr. | 175/82 |
| 4,007,797 | 2/1977 | Jeter | 175/26 |
| 4,303,134 | 12/1981 | Dismukes | 175/61 |
| 4,305,462 | 12/1981 | Eilers et al. | 166/117.6 |
| 4,397,360 | 8/1983 | Schmidt | 175/61 |
| 4,420,049 | 12/1983 | Holbert | 175/45 |
| 4,427,062 | 1/1984 | Tower | 166/113 |
| 4,429,741 | 2/1984 | Hyland | 166/63 |
| 4,431,053 | 2/1984 | Morrow | 166/117.5 |
| 4,527,639 | 7/1985 | Dickinson, III et al. | 175/61 |
| 4,693,327 | 9/1987 | Dickinson et al. | 175/61 |
| 4,733,732 | 3/1988 | Lynch | 175/9 |
| 4,763,734 | 8/1988 | Dickinson et al. | 175/61 |
| 4,807,704 | 2/1989 | Hsu et al. | 166/313 |
| 4,852,666 | 8/1989 | Burnet et al. | 175/61 |
| 4,928,767 | 5/1990 | Jelsma | 166/377 |
| 5,012,877 | 5/1991 | Winters et al. | 175/80 |
| 5,035,292 | 7/1991 | Bailey et al. | 175/45 |
| 5,052,502 | 10/1991 | Jurgens et al. | 175/80 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,148,877 | 9/1992 | MacGregor | 175/79 |
| 5,154,231 | 10/1992 | Bailey et al. | 166/298 |
| 5,193,620 | 3/1993 | Braddick | 166/382 |
| 5,210,533 | 5/1993 | Summers et al. | 175/45 X |
| 5,222,554 | 6/1993 | Blount et al. | 166/117.6 |
| 5,398,754 | 3/1995 | Dinhoble | 166/117.6 |

APPARATUS FOR RETRIEVING WHIPSTOCK

FIELD OF THE INVENTION

The field of this invention relates to retrieving of whipstock assemblies for deviating the direction of drilling in a cased borehole.

BACKGROUND OF THE INVENTION

Whipstocks are well known in the oil well drilling art and have been utilized for many decades. A whipstock is an elongated tool having a long, tapered concave interior surface and a long straight cylindrical outside surface. Whipstocks are used in cased borehole and open borehole. This invention relates to cased borehole. The whipstock is set downhole in an oil well such that the concave interior surface thereof provides a guide to a milling tool to mill out an opening in the oil well casing to provide a new, angled direction for additional drilling. While whipstocks have been known for many years, their present use is increasing due to the cost of drilling, making it desirable to drill as many wells as possible off of a central, cased borehole.

In order to utilize a whipstock, it is necessary to set or anchor the whipstock against the casing in the borehole at the location where it is desired to mill a hole through the casing to begin drilling in a new direction. Due to the long, tapered upper end of the whipstock being substantially smooth, it is difficult to design a suitable tool that is attachable to a running string for retrieving the whipstock after it has served its purpose.

SUMMARY OF THE INVENTION

It is an object of this invention to provide a tool capable of temporary attachment to the upper portion of a whipstock for retrieving the whipstock from cased borehole.

The apparatus of this invention includes a first mandrel having an upper end adapted for attachment to a drill string or running string, and a lower end. A second mandrel is positioned below the first mandrel. A cam/grip means is attached to the lower end of the first mandrel and to the second mandrel for movement between a released position and a gripping position in which the cam/grip means grippingly engages a whipstock. The cam/grip means includes means for moving to the released position when the second mandrel moves toward the first mandrel and for moving to the gripping position when said second mandrel moves away from the first mandrel. In this manner, the apparatus is lowered downwardly on a running string into the cased borehole and positioned over the upper portion of the whipstock. Then, the retrieving tool apparatus is moved upwardly by raising the running string, and as the retrieving tool apparatus is moved upwardly, a camming surface of the cam/grip means is pivoted into engagement against the interior concave surface of the whipstock so that the retrieving tool grips or latches tightly onto the whipstock so that the whipstock is pulled out of the cased borehole with the retrieving tool. The apparatus described in this summary is exemplary only. The detailed description of the preferred embodiment of the invention will follow and the claims will set forth the subject matter sought to be patented.

DESCRIPTION OF THE PREFERRED EMBODIMENT

Figure 1:
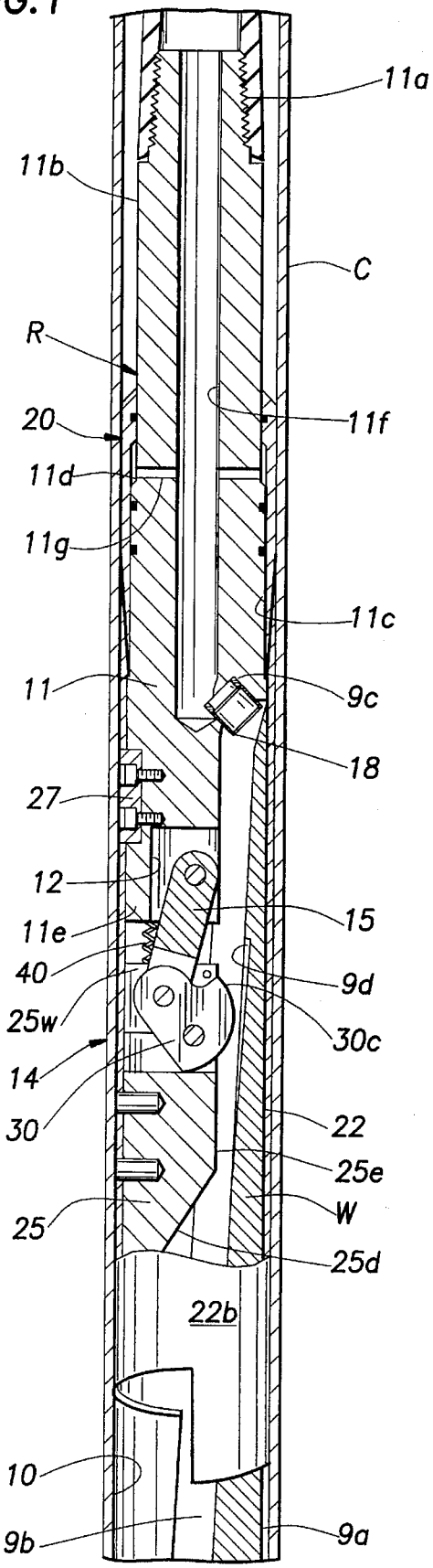
FIG. 1 is a side, sectional view of the retrieving tool of this invention illustrated in position over the upper portion of a whipstock within a cased borehole.
Figure 2:
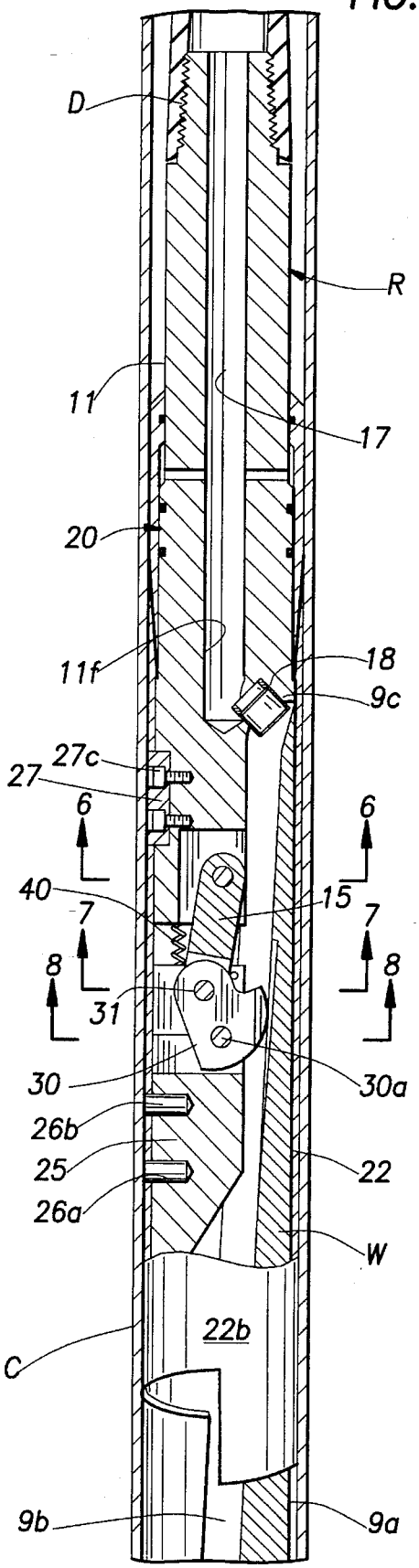
FIG. 2 is a side, sectional view similar to FIG. 1 with the camming element of the invention positioned in gripping engagement against the upper portion of the whipstock for removal of the whipstock.

Referring to the drawings, the letter R generally designates the retrieval tool of the preferred embodiment of this invention. The retrieving tool R is shown in FIGS. 1 and 2 positioned inside of casing C which is set in the bore of an oil or gas well during drilling. The casing C is typically large diameter pipe providing a generally smooth interior cylindrical surface 10. The retrieving tool R is designed to be run downhole in an oil or gas well to retrieve, that is, grip and remove, a whipstock W. Referring to FIGS. 1 and 2, the whipstock W has an upper tapered portion which includes an outer convex surface 9a and an inner concave surface 9*b*, which inner surface is tapered to upper point 9*c*. The whipstock may have a slight recess 9*d*. The remainder of the whipstock, as well as the upper portion W shown is well-known in the art.

The retrieving tool R includes an upper body or mandrel generally designated as 11 having an upper threaded end 11*a* which is adapted to threadedly attach to the lower end of a drill or running string generally designated as D. Such a drill string, running or work string is typically a series of special pipe screwed together to form a string which may be raised and lowered from the drilling platform located above ground.

Figure 6:
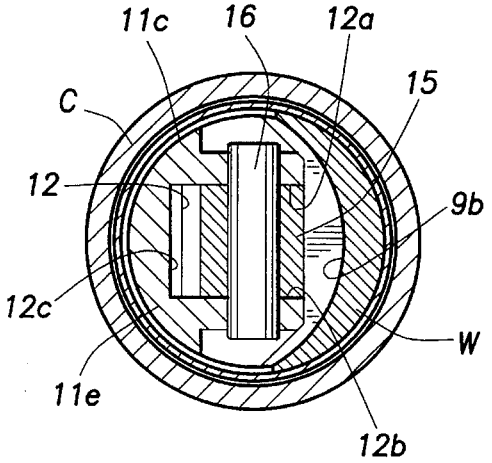
FIG. 6 is a sectional view of the cam/grip means taken along line 6—6 of FIG. 2.
Figure 7:
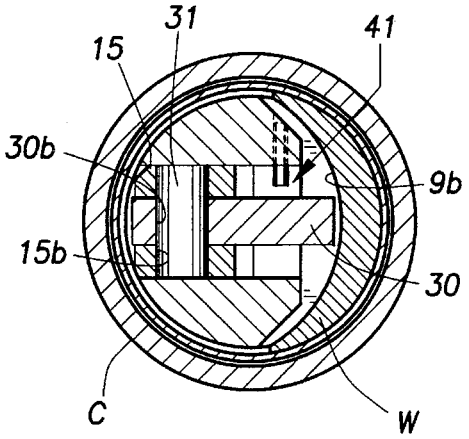
FIG. 7 is a sectional view of the cam/grip means taken along line 7—7 of FIG. 2.
Figure 5:
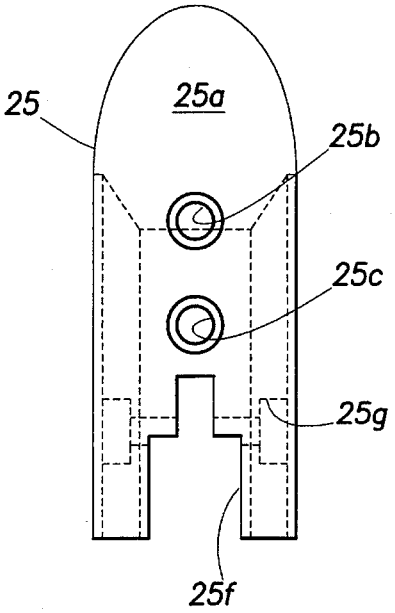
FIG. 5 is a top view of the lower, moveable mandrel of this invention.
Figure 8:
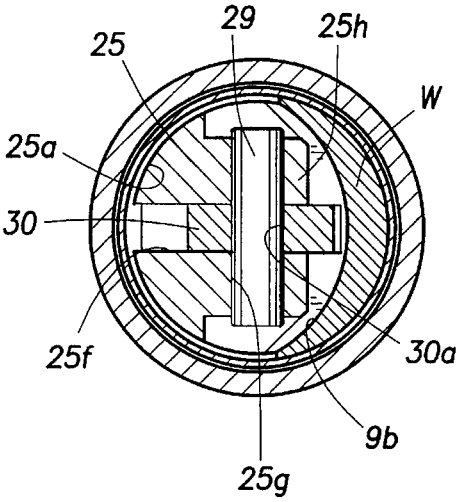
FIG. 8 is a sectional view of the cam/grip means taken along line 8—8 of FIG. 2.

The upper mandrel 11 is a generally cylindrical member having a first outside diameter at wall 11*b* which is generally the same as the outside diameter of the pipe of the running string D. The wall 11*b* joins a lower section of the tool to outer cylindrical wall 11*c* by connecting shoulder 11*d* such that the cylindrical wall section 11*c* has a slightly greater or larger outer diameter than the diameter of wall section 11*b*. The outer wall section 11*c* terminates in lower or bottom mandrel end portion 11*e*. An internal generally U-shaped recess 12 is machined into the lower end 11*e* of the mandrel 11. As illustrated in FIGS. 1, 2 and 6, the recess 12 is formed by interior side walls 12*a* and 12*b* and interior end wall 12*c*.

A cam/grip means generally designated as 14 includes an upper or first link 15 which is mounted within the recess 12 by pin 16 for pivotal movement with respect to the lower portion 11*e* of the mandrel.

The upper mandrel 11 further includes a central passageway 11*f* which extends along the longitudinal axis 17 of the tool R. The passageway or bore 11*f* terminates in an angularly directed nozzle 18 in order to allow the passage of fluid through the tool R as the tool is lowered or raised in the oil or gas well. The upper mandrel further includes a plurality of radially extending ports 11*g* to be further described hereafter.

Figure 4:
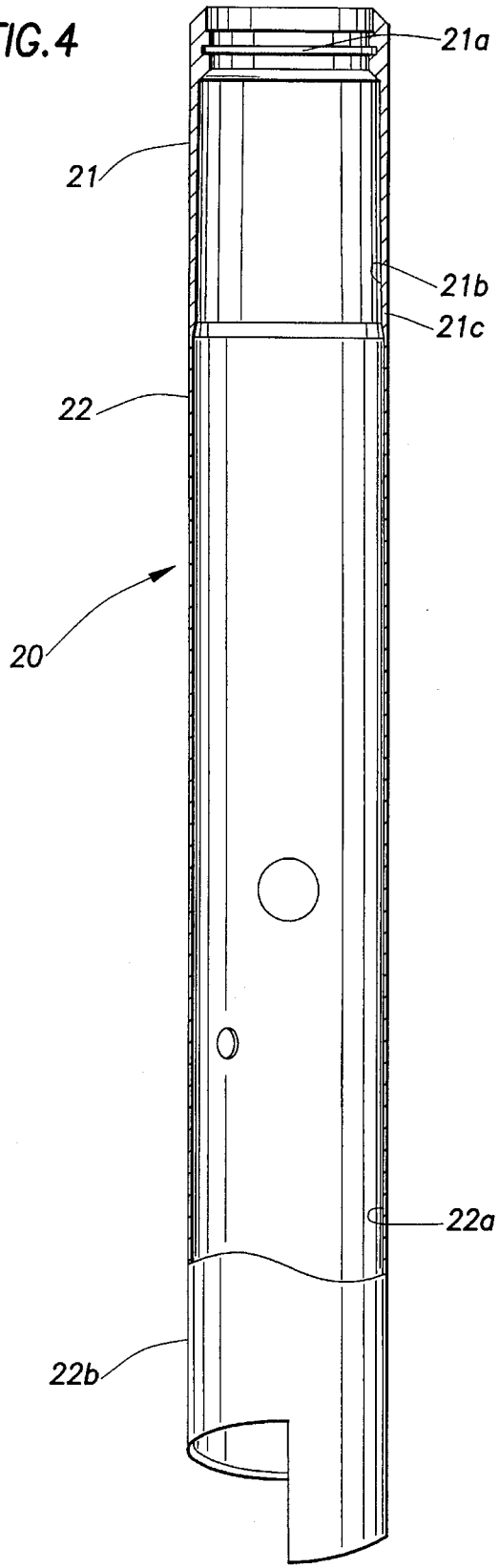
FIG. 4 is a top view of the releasing or actuator cylinder of this invention.

An actuating or release cylinder assembly or release means generally designated as 20 is mounted over upper cylindrical surfaces 11*b* and 11*c* of the upper mandrel 11 for slidable movement with respect to the mandrel. The actuating cylinder assembly 20, as shown in FIG. 1, 2 and 4, includes hollow tubular members 21 and 22 joined at male threaded portion 21*b* and female threaded portion 22*c* to form a threaded connection. The cylindrical hollow member 21 has internal, annular recesses 21*a* for receiving seal rings to mount the actuating cylinder assembly 20 for slidable, sealable movement on upper cylindrical surface 11*b* of the mandrel 11. Member 22 of the actuating cylinder 20 includes a lower portion 22*b* which extends downwardly (to the left in FIGS. 1–2) past the cam/grip means 14 and over a lower tool mandrel generally designated as 25. The lower mandrel 25, which will be described in more detail hereinafter, is attached to the inside wall 22*a* of the actuating cylinder member 22 by welded plugs 26*a* and 26*b*. In this manner, movement of the actuating cylinder assembly 20 upwardly and downwardly will cause similar upward and downward displacement of the lower mandrel 25, which is not directly attached to the upper mandrel 11.

Figure 3:
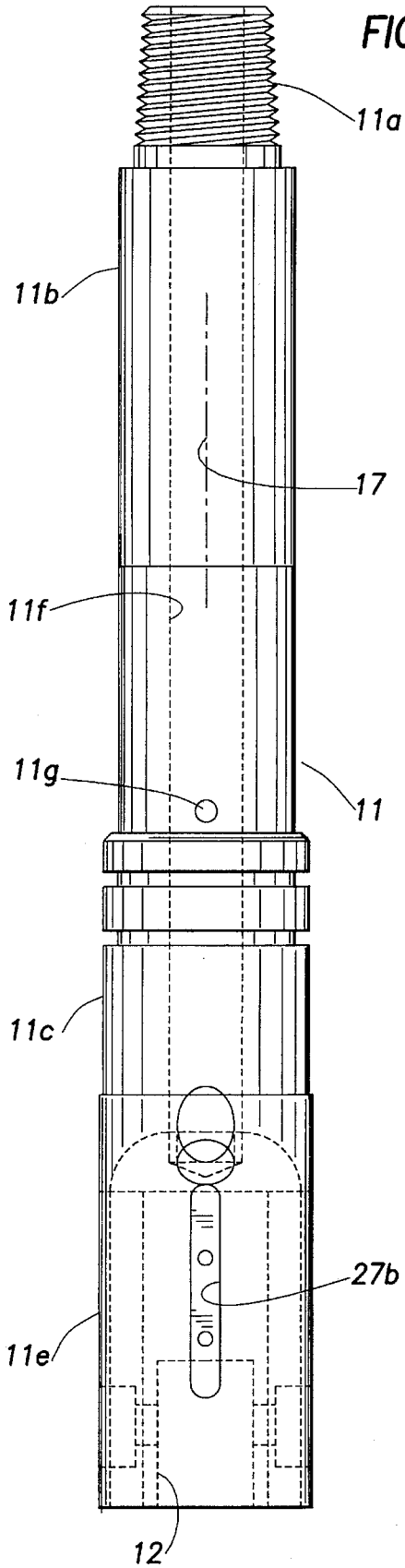
FIG. 3 is a top view of the upper mandrel of the retrieving tool of this invention.

The actuating cylinder 22 includes an elongated slot which receives an elongated key element 27 which is mounted into a recess 27*b* (FIG. 3) in the lower portion 11*e* of the mandrel 11 by set screws 27*c*. In this manner, the actuating cylinder is moveable or slidable longitudinally along the upper mandrel without rotation.

Referring to FIGS. 1, 2, 5 and 8, lower mandrel 25 includes an externally facing partially cylindrical or convex wall surface 25*a* having essentially the same radius of curvature as the inside wall 22*a* of the actuating cylinder 22 so that the lower mandrel surface 25*a* abuts the inside cylindrical surface 22*a* of the actuating cylinder such that welded plugs may be welded into bore holes 25*b* and 25*c* in the mandrel 25. The interior face of the mandrel is tapered by angular wall member 25*d* which joins a longitudinally extending straight wall portion 25*e*. A generally U-shaped slot 25*f* is machined into the upper portion of the lower mandrel along with transverse shaft bore 25*g*. The transverse shaft bore 25*g* receives pin 29 which extends through the mandrel bore 25*g* to mount a second or lower cam link 30 for pivotal movement with respect to the upper portion of the mandrel 25. The pin 29 is retained in place by means of snap rings on either end.

The lower or cam link 30, which forms part of the cam/grip means 14, is illustrated in FIGS. 1, 2, 7 and 8. As viewed in transverse cross-section in FIGS. 1 and 2, the second or cam link 30 includes a first opening or bore 30*a* which receives the pin 29, thus mounting the cam/link 30 for pivotal movement with respect to the lower mandrel 25 in response to upward and downward movement of the lower mandrel, itself. The cam link 30 is further pivotally connected to the first or upper link 15. The upper portion of the cam link 30 includes a bore or opening 30*b* which is aligned with a bore or opening 15*b* in the upper link 15. The pivotal connection is completed by pin 31 which extends through the respective openings in the upper and cam links.

In this manner, upward and downward movement of the lower or floating mandrel 25, with respect to the upper or stationary mandrel 11, causes pivotal movement of the cam link 30. The cam link 30 includes a camming surface or lobe 30*c* formed of a radius of curvature or spiral which is off center from the center of the lower mandrel pin 29. In this manner, the lobe or gripping surface portion 30*c* is moveable into and out of engagement with the inside surface of the whipstock W as the lower mandrel 25 is moved away from or toward the upper mandrel 11.

Operation

In operation, the retrieving tool R is lowered into the hole on running string D and is attached to the upper tapered portion of the whipstock W by positioning the lower end 22*b* of the actuating cylinder assembly 20 over the upper tapered end of the whipstock. When the upper mandrel 11 is pulled upwardly with respect to the whipstock (to the right as shown in FIGS. 1 and 2) by raising running string D, the upper mandrel 11 is moved away from the lower mandrel 25 and actuating cylinder 22 connected thereto such that the cam link 30 and upper link 15 are pivoted. A series of springs 40 (only one of which is shown) are mounted between the bottom of the lower end 11*e* of the upper mandrel and the top of the upper portion 25*h* of the lower mandrel 25 to resiliently urge the lower mandrel away from the upper mandrel. In this manner, the springs such as 40 urge the lower mandrel away from the upper mandrel, thereby urging the cam link 30 clockwise toward a position of engagement with the casing C. As the cam link 30 pivots in a clockwise direction as illustrated in FIGS. 1–2, the cam or lobe gripping portion 30*c* engages the whipstock W and thereafter further pull upwardly upon the mandrel 11 will cause the cam link to engage the whipstock W even tighter. A pin 41 (FIGS. 1,2 and 7) is mounted in the upper portion 25*h* of the lower mandrel 25 and extends into the slot 25*f* to act as a stop member to prevent the linkage of the lower cam member 30 and upper cam member 15 from becoming locked in a position of alignment. Once gripping engagement is set, the running string D is used to retrieve the whipstock by raising the whipstock W in the casing C.

While ordinarily it is not necessary to release the retrieving tool R from engagement with the whipstock, there are some circumstances, such as when the whipstock is stuck in the hole, that it is necessary to release the retrieving tool R from its engagement to the whipstock W. The retrieving tool R is released by the introduction of pressurized fluid downwardly through the running string D and through radial passageways 11*g* of the upper mandrel 11 thereby inserting fluid into the cavity formed between the upper portion of the actuator cylinder 21 and the upper surface 11*b* of the mandrel. The assertion of fluid under pressure into this annular area causes the attached actuator cylinders 21 and 22 to move upwardly (to the right in FIGS. 1 and 2) thus moving the attached lower mandrel 25 upwardly against the urging of the spring 40. Upward movement of the lower mandrel 25 toward the upward mandrel 11 causes a pivoting counter-clockwise as viewed in FIGS. 1 and 2 of the cam link 30 thus moving the camming surface 30*c* away from engagement with the whipstock W.

Having described the invention above, various modifications of the techniques, procedures, material and equipment will be apparent to those in the art. It is intended that all such variations within the scope and spirit of the appended claims be embraced thereby.

We claim:

1. Apparatus for retrieving a whipstock downhole in an oil or gas well, comprising:

a first mandrel having an upper end adapted for attachment to a work string, and a lower end;

a second mandrel positioned below said first mandrel; and, cam/grip means attached to said lower end of said first mandrel and to said second mandrel for movement between a released position and a gripping position in which said cam/grip means is positioned to grippingly engage a whipstock, said cam/grip means including means for moving to said released position when said second mandrel is moved toward said first mandrel and for moving to said gripping position when said second mandrel moves away from said first mandrel.

2. The apparatus of claim 1, including:

release means mounted over said first mandrel for movement with respect to said first mandrel for engaging and moving said second mandrel and cam/grip means to said released position.

3. The apparatus of claim 2, including:

said release means being movable in response to hydraulic pressure.

4. The apparatus of claim 1, wherein said cam/grip means includes:

a first link, and means mounting said first link on said lower end of said first mandrel for pivotal movement with respect to said mandrel;

a second link, and means mounting said second link on said second mandrel for pivotal movement with respect thereto;

said first and second links being pivotally connected to each other; and said second link including a camming surface which is moveable into engagement with a whipstock in response to movement of said second mandrel away from said first mandrel.

5. The apparatus of claim 4, including:

said means mounting said second link for pivotal connection is a pin extending through said second mandrel; and said second link camming surface having a curved surface portion having a radius of curvature located outside an axis of rotation of said second link about said pin extending through said second mandrel.

6. The apparatus of claim 1, including:

said first mandrel being cylindrical in configuration and having a passageway therein extending from said first end to said second end such that fluid is circulated through said first mandrel.

7. The apparatus of claim 1, including:

a release actuating cylinder mounted over said first mandrel for movement with respect thereto, said release actuating cylinder having seal means mounting said cylinder for slidable, sealable movement over said first mandrel, said cylinder and said first mandrel cooperating to form a sealed cavity, where upon the entry under pressure of hydraulic fluid into said cavity, said cylinder is moved upwardly;

said release actuating cylinder being attached to said second mandrel such that upward movement of said cylinder moves said second mandrel toward said first mandrel thereby moving said cam/grip means toward said releasing position.

8. The apparatus of claim 7, including:

said first mandrel having a key which extends into a slot in said release actuating cylinder such that said cylinder is mounted for slidable non-rotational movement.

* * * * *